US006349750B1

(12) United States Patent
Fujiwara

(10) Patent No.: US 6,349,750 B1
(45) Date of Patent: Feb. 26, 2002

(54) WOVEN FABRIC AND METHOD FOR FORMING ARTICLES THEREFROM

(75) Inventor: Toshio Fujiwara, Tokyo (JP)

(73) Assignee: Kabushiki Kaisha Miyake Design Jimusho, Tokyo (JP)

( * ) Notice: Subject to any disclaimer, the term of this patent is extended or adjusted under 35 U.S.C. 154(b) by 0 days.

(21) Appl. No.: 09/616,440

(22) Filed: Jul. 14, 2000

(30) Foreign Application Priority Data

Oct. 4, 1999 (JP) ..... 11-282915

(51) Int. Cl.[7] ..... D03D 3/00

(52) U.S. Cl. ..... 139/384 R; 139/383 R; 156/256

(58) Field of Search ..... 112/440, 475.09; 156/256; 28/170; 139/383 R, 384 R

(56) References Cited

U.S. PATENT DOCUMENTS 4,357,714 A * 11/1982 Ito ..... 2/97
5,230,764 A * 7/1993 Moll ..... 156/256

FOREIGN PATENT DOCUMENTS

JP H4-66347 of 0000
JP H5-51836 of 0000
JP S52-12306 of 0000
JP S54-11053 of 0000
JP S62-153304 of 0000

OTHER PUBLICATIONS

Sen–I Kogaku (Fabric Engineering) II, Orimono (Textiles) Nihon Sen–I Kogyo Kyoiku Kenkyukai (Japan Fabric Inductry Education Workshop) pp. 58 and 59.

* cited by examiner

*Primary Examiner*—John J. Calvert
*Assistant Examiner*—Robert H. Muromoto, Jr.
(74) *Attorney, Agent, or Firm*—Pitney, Hardin, Kipp & Szuch LLP

(57) ABSTRACT

A fabric woven under a double weave by using a jacquard machine, which has a first layer for forming front bodies of garments and a second layer for forming back bodies of the garments. The first and second layers are connected with each other by interwoven portions along substantially closed contour lines (outlines) as repeated patterns. The fabric is subjected to a cutting along the contour lines, while the interwoven portions are at least partly left except at locations where openings for passage of parts of a human body are to be formed. As a result, a garment can be obtained without any substantial sewing process.

11 Claims, 12 Drawing Sheets

WOVEN FABRIC AND METHOD FOR FORMING ARTICLES THEREFROM

BACKGROUND OF THE INVENTION

1. Field of the Invention

The present invention relates to a woven fabric, which is suitable for producing articles such as garments or bags without substantially necessitating any sewing process.

2. Description of Related Art

In a garment making from a woven fabric, a process taken unchanged from an old day is that the woven fabric is subjected to a cutting along respective pattern papers to obtain various cut pieces such as a front body, a back body and a collar and that the cut pieces are subjected to a sewing process where the cut pieces are connected with each other so as to obtain a garment.

From the view point of increase in an efficiency of the garment making, an automation is possible as far as the cutting is concerned by employing computerized cutting. Namely, in a semi custom-made men's garment, a system is now widely employed, in which system pattern papers corresponding to various sizes are stored in a computer, from which stored pattern papers a pattern is selected, which is the best matched to the result of size measurement, to which selected pattern paper a suitable correction is cone on a computer display, along which corrected pattern paper a cutting is done by using a laser cutting device.

As far as sewing is concerned, an automatic operation is much more difficult, and therefore a manual operation is, basically, still used. Therefore, the sewing is a bottleneck from the viewpoint of increase in production efficiency as well as of decrease in a production cost. Under these circumstances, there has heretofore been a strong requirement as to a development in a garment making by which any sewing is not necessary.

As far as weft knitting is concerned, where interwoven loops can be desirably laterally moved for controlling a knitting width, a garment with no sewing has been conventional from old days where only manual knitting is done. Furthermore, even a mechanical knitting is concerned, sophisticated weft knitting machines have, recently, commercially been available, where one to one independent electronic control of knitting needles is employed, thereby realizing, without sewing, a fully automated garment making, including a interweaving at opened portions of the garment such as a sleeve, a collar and a base or hemline. As to this kind of weft knitting machine, refer, for example, Japanese Examined Patent Publication No. 3-75656.

However, a weaving technique is completely different from a weft knitting technique. In other words, weaving technique can not, at any means, be applied to the weaving technique. The present invention aims, thus, to eliminate substantially sewing, also, in a garment making from a woven fabric.

SUMMARY OF THE INVENTION

According to a first aspect of the present invention, a woven fabric is provided, having repeated patterns to be cut to articles, said fabric comprising a plurality of layers woven by a jacquard, among which layers at least one first layer becomes one side of the article while at least one remaining second layer becomes the other side of the article, said fabric further comprising interwoven portions for interweaving said first and second layers each other along a contour line of said article except at locations which become openings of the article as produced, said repeated patterns constructed by said interwoven portions being distributed along substantially entire length and the width of the fabric.

According to another aspect of the present invention, a woven fabric is provided, having repeated patterns to be cut to garments, said fabric comprising a plurality of layers woven by a jacquard, among which layers at least one first layer becomes a front body of a garment while at least one remaining second layer becomes back body of a garment, said fabric further comprising interwoven portions for interweaving said first and second layers each other along a contour line of the garment, said repeated pattern constructed by said interwoven portions being distributed along substantially entire length and the width of the fabric.

According to still another aspect of the present invention, a method for forming articles from a fabric is provided, comprising the steps of:

weaving, by using a jacquard, a fabric having a plurality of layers, among which layers, at least one first layer becomes one side of the article while the remaining at least one second layer becomes the other side of the article, while interweaving said first and second layers with each other along a contour line of the article, and;

cutting the fabric along said contour line, thereby separating, from the fabric, an article in which the first and second layers are connected with each other by means of the interweaving except at a location which becomes an opening of the article.

According to further another aspect of the present invention, a method for forming garments from a fabric is provided, comprising the steps of:

weaving, by using a jacquard, a fabric having a plurality of layers, among which layers, at least one first layer becomes one side of the garment while the remaining at least one second layer becomes the other side of the garment, while interweaving said first and second layers with each other along a contour line of the article, and;

cutting the fabric along said contour line, thereby separating, from the fabric, a garment in which the first and second layers are connected with each other by means of the interweaving except at a location which becomes an opening of the garment, such as a collar, a sleeve or a base et al.

According to the present invention, a cutting of the fabric along contour line is done in such a manner that garments are separated. The cutting is done in such a manner that, except at positions which become openings such as a collar, sleeve and base or hemline, the interweavings are at least partially remained. As a result, an article or garment is obtained, in which the upper and lower sides are, along the contour line of the garment, connected with each other by the interwoven parts, while necessary openings for a passage of portions of wearer are provided. It should be noted that the contour lines are repeated patterns on the fabric. In other words, the size of the article or garment as obtained correspond to the size of the repeated pattern. Furthermore, as easily understood by those skilled in this art, the size of a repeated pattern on the fabric corresponds to the number of warp yarns which can be subjected to independent shedding motions. This means that a large size of the article as cut out from the fabric can be obtained when a jacquard of a large number of hooks are used. Thus, when a jacquard of the number of hooks, which correspond to the total number of warp yarns, the contour of the article can extend across the entire width of the weft width, thereby obtaining a maximum size of the article or garment. Furthermore, due to the use of the jacquard, a desired independent shedding control of the every warp yarns in one repeat (outline of the garment) becomes possible, so that a desired weaving design can be imparted to both of the upper and lower side of the article or a front and back bodies of a garment. In a recently developed jacquard machine, a completely computerized type from the reading of a design paper to a hook position control is realized. This type of jacquard machine is suitable for practicing the present invention.

Articles according to the present invention other than the garments include bags et al. In this case it is possible that such a part like tying string or shoulder strap can be integrally formed in the fabric. Thus, a cutting of the fabric to the bags allows these parts to be also separated as the string or a shoulder strap.

According to the present invention, it is possible that the first layer is a front body of a garment while the second layer is a back body of the garment. The front and back bodies are interwoven along the contour line of the garment. A cutting of the fabric is done along the contour line so that the interweaving parts are at least partially remained, thereby preventing the front and back bodies from being separated in the garments. At the areas such as the collar, sleeve and hemline, where portions of a human body are passed, any interweaving may not be provided from the beginning. Thus, in this case, a mere cutting of the fabric along the contour line allows the opening at the collar, sleeve and hemline to be automatically created. As an alternative, a weak interweaving yarns may exist at the portions of the collar, sleeve and hemline, which are withdrawn or removed after the execution of the cutting. According to the present invention, it is intended that any additional process may not be applied to the cut-out portions at the collar, sleeve and hemline et al. Thus, a particular kind of weave structure, by which a loosening is less likely, can be selected. As another way for preventing a loosening, an arrangement of a pattern as a contour line of a garment in a fabric may be such that a cut line runs in a direction other than that of the warp or weft yarn so long as it is possible. Furthermore, it may also possible that, as for warp or weft yarns, bulky textured yarns such as a wooly nylon can be used at a predetermined spacing. A bulkiness of the textured yarn is effective for making a mutual engagement of the yarns to be increased, thereby making the loosening to be less likely. Furthermore, according to the concept of the present invention, the cut-out portions at the collar, sleeve and hemline, as they are, become the openings of the completed product. Thus, an appearance of the garments according to the present invention is quite different from that of usual garments in which the sewing or interweaving is done. However, such a difference is from the view point of design may be one cause which make the product to be accepted in the market without generating any sense of disharmony. Finally, if it is necessary, a interweaving for preventing loosing can be done at the cut-out portions. In this case, the garment as obtained is not the one that is made without any additional sewing. However, in comparison with the prior art, a work load at the sewing process can highly be reduced.

BRIEF EXPLANATION OF ATTACHED DRAWINGS

DETAILED EXPLANATION OF PREFERRED EMBODIMENTS

Figure 1:
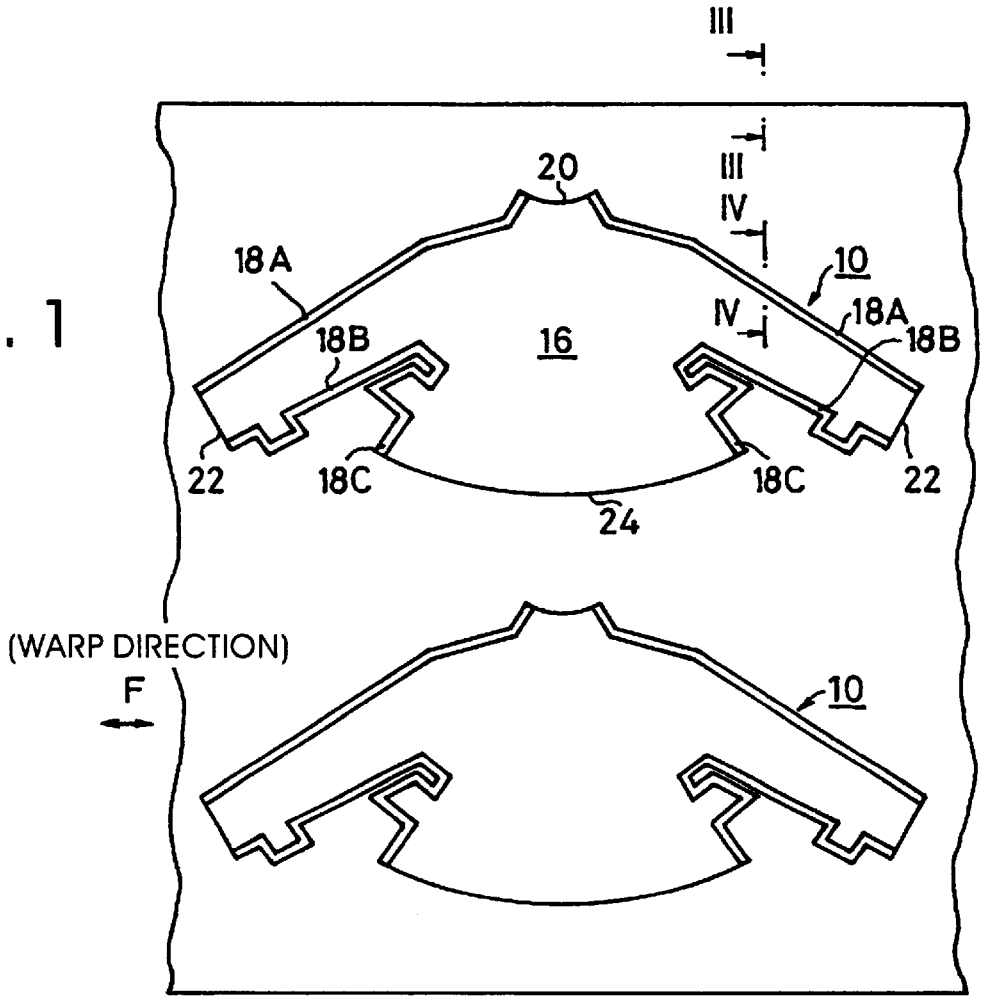
FIG. 1 is as plan view of a fabric according to the present invention, illustrating an arrangement of repeated patterns (outline of garment) on the fabric.
Figure 2:
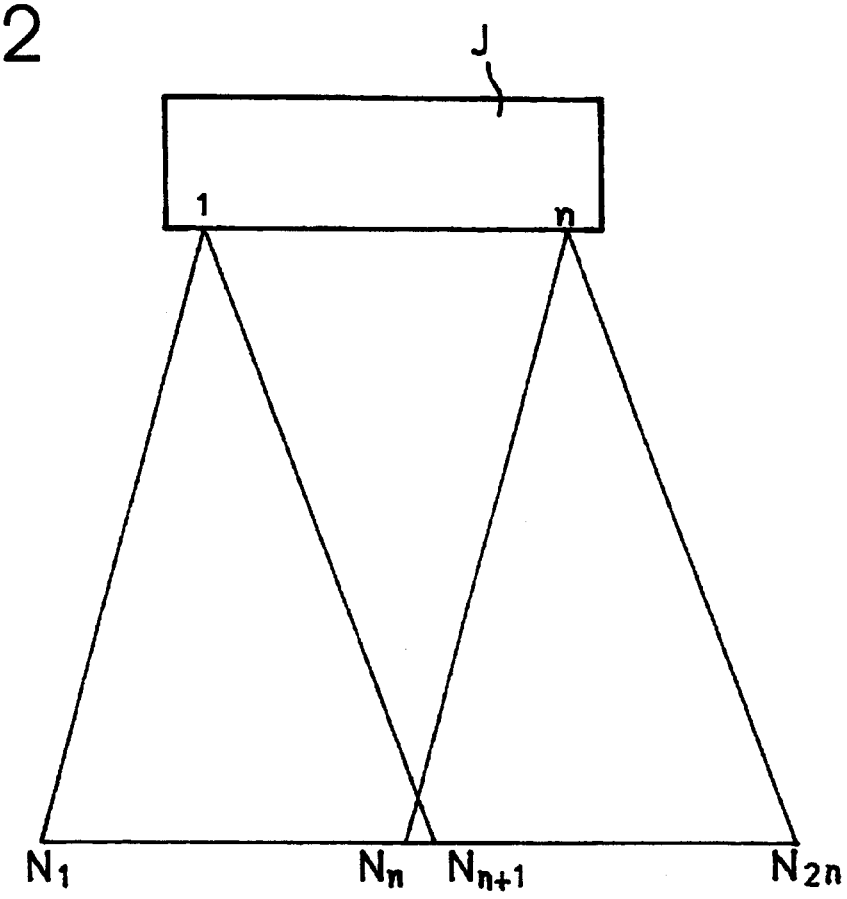
FIG. 2 is an illustration of an example of harnessing of warp yarns by a jacquard.

Now, embodiments of the present invention will be explained with reference to attached drawings. In FIG. 1, an arrow F illustrates a direction along which warp yarns run. A reference numeral 10 denotes, schematically, a repeated pattern on the fabric, which is subjected to cutting along the contour line of the pattern, which allow a garment, for example, a jacket, to be obtained without any additional sewing process. In this embodiment, a jacquard is used for obtaining the fabric, which has hooks of a number which substantially corresponds to a number of warps in a half weaving width. Namely, as shown in FIG. 2, the jacquard J has hooks numbered from 1 to n, which is, for example, equal to 4,300. The hooks 1 to n are harnessed not only with warp yarns $N_1$ to $N_2$, respectively but also with $N_{n+1}$ to $N_{2n}$, respectively. In other words, each hook executes a shedding movement for two warp yarns. In view of this, as shown in FIG. 2, two patterns 10 are arranged along a weft direction, i.e., a fabric wide direction.

As for a jacquard machine, one of those that are available, for example, from Stäubli AG resided at CH-8810, Horgen, Switzerland can be employed.

Figure 3:
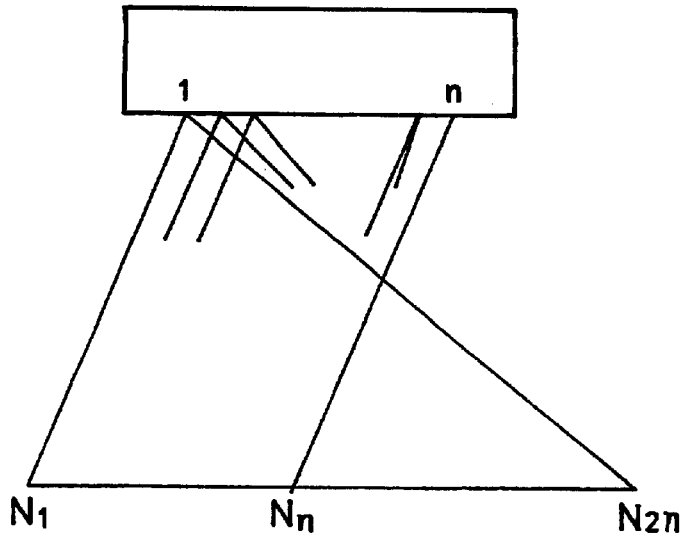
FIG. 3 is an illustration of another example of harnessing of warp yarns by a jacquard.

FIG. 3 shows another modification of harnessing, which allows two repeats of pattern to be arranged in the fabric width direction. Namely, in this case, the hooks 1 to n are associated with the warps $N_1$ to $N_n$, respectively and with warps $N_{2n}$ to $N_{n+1}$, respectively. Therefore, in this modification, two repeated patterns as obtained are arranged symmetrically with respect to the longitudinal central line of the fabric width.

Figure 4:
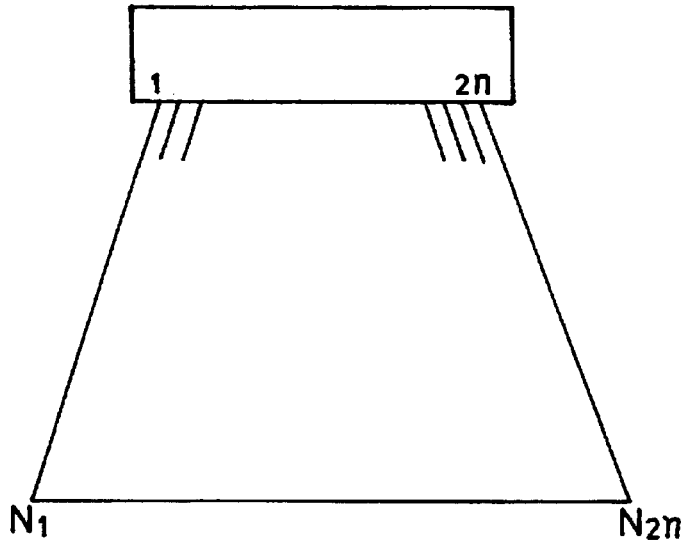
FIG. 4 is an illustration of further another example of harnessing of warp yarns by a jacquard.

FIG. 4 shows a still another modification of harnessing. In this case, the jacquard has hook 1 to 2n of a number doubled with respect to those shown in FIGS. 2 and 3. Namely, the hooks 1 to 2n are harnessed with respective single warps, i.e., the warps $N_1$ to $N_{2n}$, respectively. In view of this, the modification can provide a pattern which extends along the entire width of the woven fabric.

Figure 5:
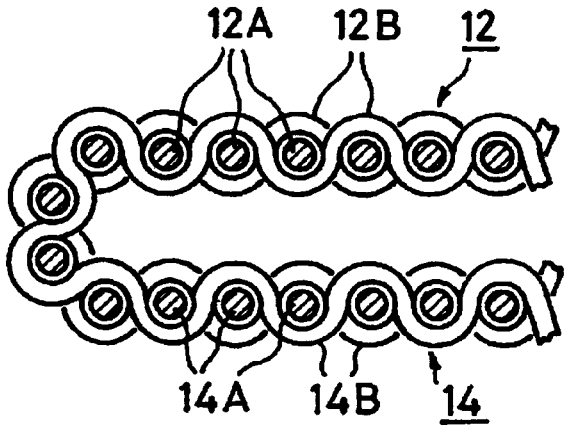
FIG. 5 is a cross sectional view taken along line V—V in FIG. 1, illustrating a construction of the fabric at salvage portion in a hose weave structure.

The fabric according to the present invention is, basically, formed as a double weave structure. Namely, beneath the top woven layer shown in FIG. 1, another woven layer is provided. Namely, in FIG. 5, a reference numeral 12 denotes schematically an upper woven fabric layer and 14 a lower woven fabric layer. The upper woven layer 12 is constructed by warp yarns 12A and weft yarns 12B, while the lower woven layer 14 is constructed by warp yarns 14A and weft yarns 14B. Furthermore, in this embodiment, the shown double weave structure is the type that is called as a hose weave structure, where weft yarns are commonly used between the upper and the lower layers. Namely, the weft yarns 12B in the top woven layer 12 are, at selvage area, moved into the weft yarn 14B in the bottom woven layer 14. However, the present invention can also be carried out even in a case where the double woven fabric is not the type of hose weave type but the type where the upper weft yarns 12B and the lower weft yarns 14B are completely separated at the salvage area.

According to this embodiment, in the double fabric realized as the hose weave structure, front bodies 16 of jackets are formed in the upper woven layer 12 while back bodies of the jackets are formed in the lower woven layer 14 in alignment with the respective front body. The top woven layer 12 and the bottom woven layer 14 are interwoven along a contour line of the garment in such a manner that the top layer 12 becomes a front body of the garment while the bottom layer 14 becomes a back body of the garment. These interwoven parts of a suitable width are, in FIG. 1, illustrated by reference numerals 18A, 18B and 18C. Namely, the interwoven parts 18A correspond to a line from the collar or neck to the sleeve. The interwoven parts 18B correspond to a line from an armpit to the sleeve. Finally the interwoven parts 18C correspond to a line from the armpit to a base or hemline. These interwoven parts are arranged under a bilaterally symmetrical relationship. The interwoven parts have a width which is wide enough to generate a strength which can prevent the front and back bodies from being separated during the later use of the garment as separated from the fabric.

Figure 6:
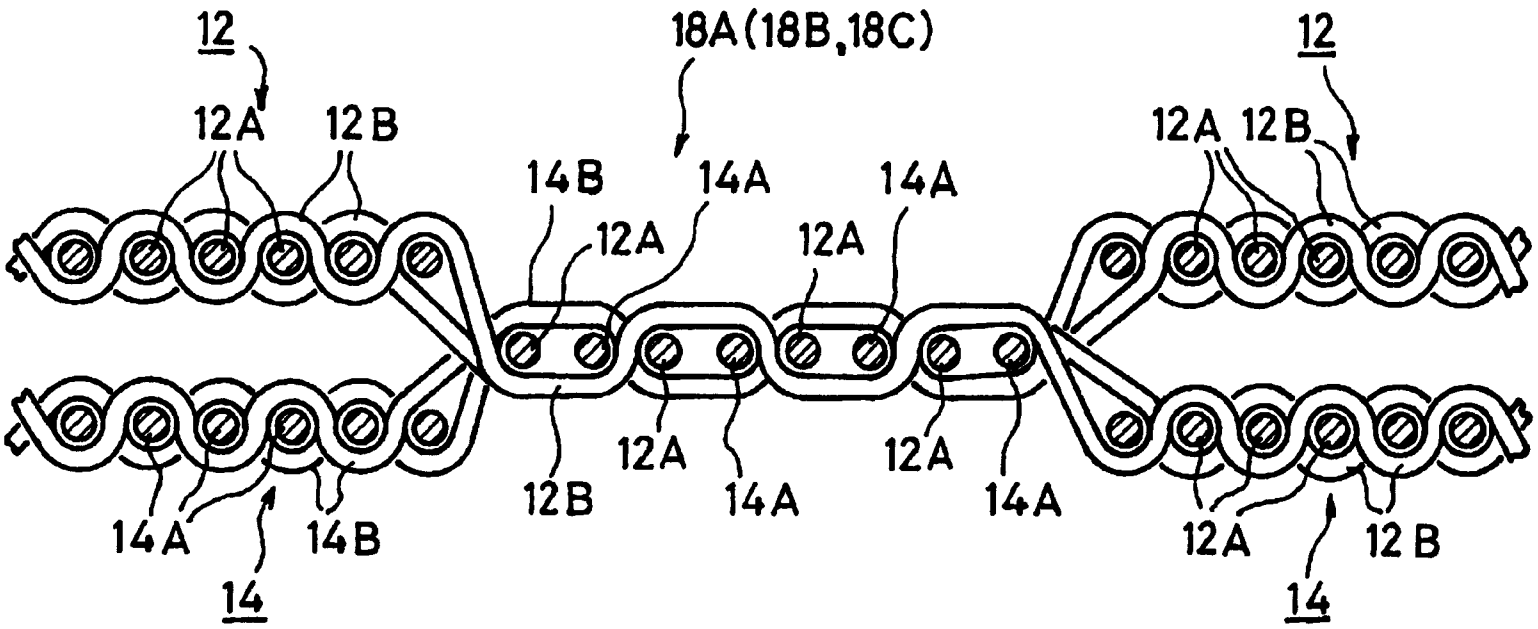
FIG. 6 is a cross sectional view taken along line VI—VI in FIG. 1, illustrating a construction of the fabric at the interwoven portion between the front and back bodies.

As shown by the example in FIG. 6, the interwoven 18A, 18B and 18C are constructed as an Oxford weave. Such an Oxford weave is a kind of a single layer fabric from the view point of classification of structure of woven fabric. Namely, in such an Oxford weave, a plurality of warp yarns and weft yarns are combined and are woven under structure such as a plain weave. It is considered that the Oxford weave is, because of its increased flexibility, suitable for use as the interwoven parts. Namely, as shown in FIG. 6, at the interwoven parts 18A, 18B and 18C, the top warp yarns 12A and bottom warp yarns 14A are, under a parallel condition, collected, while the top weft yarns 12B and the bottom weft yarn 14B are, also, under a parallel condition, collected. These collected warp and weft yarns are subjected to an weaving process. As a result, at the interwoven parts 18A, 18B and 18C as the peripheral ends of the front and back bodies 16 of the garment, the top and bottom layers are integrated to a single fabric.

In FIG. 1, a reference number 20 denotes a line along the collar or a neck, 22 a line along the sleeve and 24 a line along the base or hemline. These parts become openings when the garments are separated from the fabric. Therefore, along these lines 20, 22 and 24 any interweaving is not basically necessary. However, it is possible that, along these lines 20, 22 and 24, interwoven parts are provided in such a manner that the interwoven parts become guide lines when the jackets are cut and separated form the fabric. Furthermore, as for the woven structure at the interweaving parts, the one of reduced crossing density between warp and weft yarns can be employed, which allows the openings to be easily formed at the collar, the sleeve and the base portions when cutting to the garments are done. This construction allows the collar, the sleeve and the base portions to be apt to be loose or untangled. In order to combat this problem, a cutting can be done along a direction inclined with respect to both of the warp and weft yarns, which can prevent the fabric to be easily loosen or untangled. Furthermore, an arrangement can also be employed, wherein an introduction of a textured yarn, such as a wooly nylon as for a warp yarn is done in order to increase in the degree of the entanglement by using a bulkiness of the textured yarn. In this case, during a picking movement (a movement of a shuttle for an introduction of a warp yarn in a weaving machine), an introduction of a textured yarn can be done for every introduction of warp yarns of a predetermined number, for example, every eight warp yarns. On the other hand, it should be noted that the loose or untangled arrangement at the cut portions in the present invention can provide own aesthetic appearance, which is itself new and which may cause the products according to the present invention to be accepted to the users and/or the market.

As will be clear from the above description, a repeated pattern 10 on the fabric is a contour line of a garment, which is constructed by a front body 16 of a garment as an upper layer 12 of the fabric and a back body of the garment as a lower layer 14 of the fabric, which layers are arranged to be vertically aligned while interwoven with each other along a contour line of the garment, i.e., interwoven parts 18A, 18B and 18C. This repeated pattern is large enough so that it extends along the substantial width of the fabric. In this case, the number of the warp yarns in one repeated pattern may sometimes be as many as about 5,000. On the other hand, it is quite clear to those skilled in this art that each of the warp yarns within the repeated pattern must execute an independent shedding movement. In other words, for each of warp yarns as many as 5,000, an independent shedding movement becomes necessary. This requirement is solely attained by a jacquard machine. This is the reason why jacquard as the essential mechanism is specified in the present invention.

Figure 7:
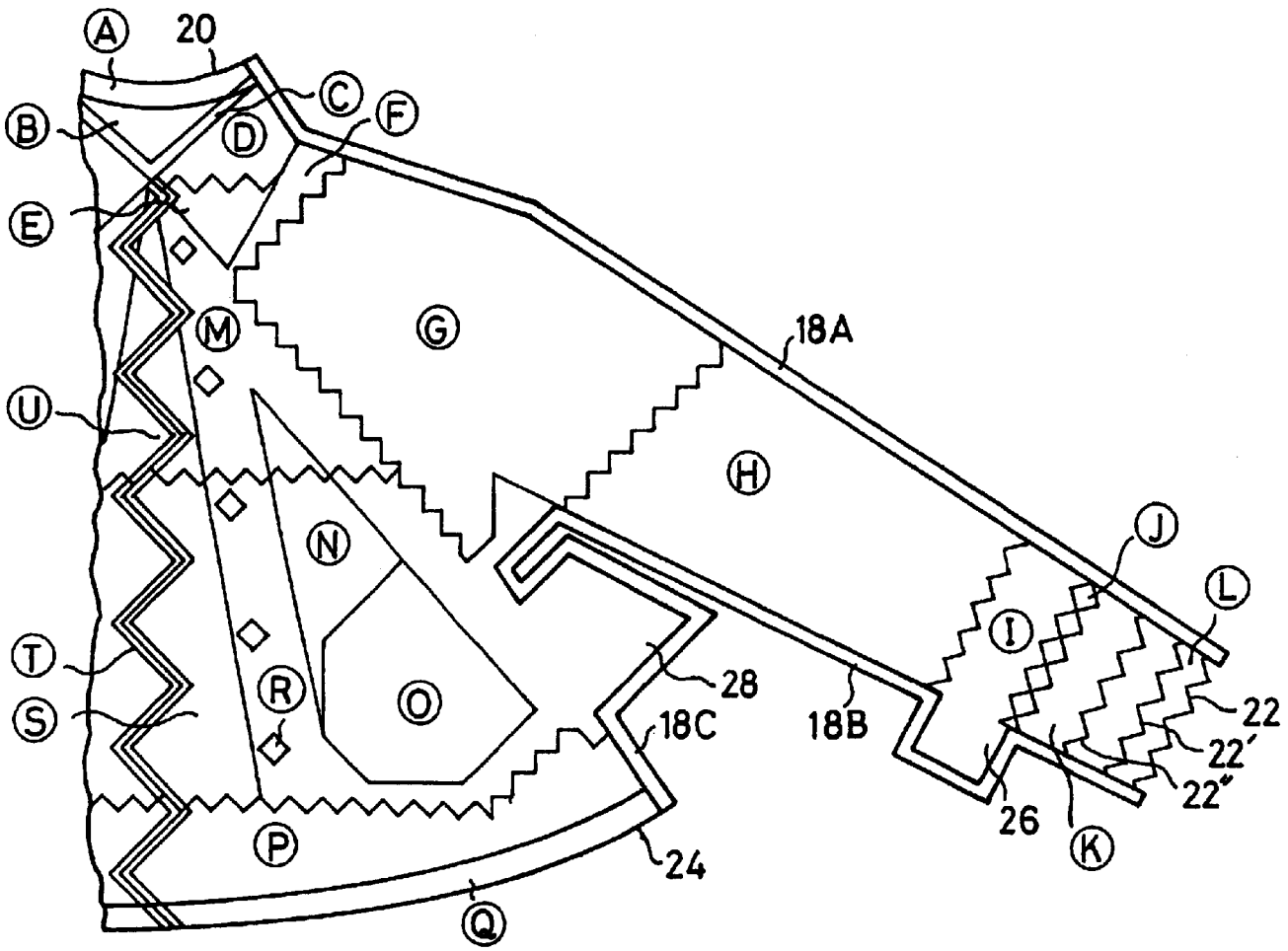
FIG. 7 shows an example of a design of the upper layer of the double fabric, constructing a front body of the garment.

As explained above, within the width the contour 10 corresponding the front and back bodies of the garment, shedding movement of each of the warp yarns can be independently controlled. Thus, any desired weave or design can be selected as for the front and back bodies. FIG. 7 shows an example of a design of the front body of the garment. In FIG. 7, the reference numerals 18A, 18B and 18C are the outline of the garment where the front and back bodies are interwoven with each other as already fully explained with reference to FIG. 1. These portions 18A, 18B and 18C are formed by any interweaving weave, which is, for example, a Bedford, as already explained with reference to FIG. 6. A cutting of a garment from the fabric along the contour 10 is done in such a manner that the interwoven parts 18A, 18B and 18C are at least partly remained, thereby preventing the front and back bodies of the garment from being separated.

As for the collar or the neck 20, the sleeve 22 and the base or hemline 24, interweaving parts can be provided, which function as guide lines for making the cutting operation to be easy. However, these parts should be opened portions for a passage of a human's parts. Thus, it is preferable that the interweaving at these parts is not so dense, thereby making the separation to be easy.

As to the region inside the lines 18A, 18B and 18C and 20, 22 and 24, i.e., at the front and back bodies, the top and bottom layers completely separated. The use of jacquard machine allows the front and back bodies to provide with desired design (weave). Namely, in one repeat of the body woven by the jacquard machine, an independent shedding of each of the warp yarns is possible. Thus, a desired pattern which, at most, may be as large as the one repeat, can be obtained in any of the front or the back body. FIG. 7 illustrates an example of a design of the front body. Namely, the front body includes circled regions A to U, which may be woven under any desired kinds of weaves while using desired kinds of threads. The degree of thermal shrinkage of the threads may be suitably different between the regions A to U, thereby obtaining a desired contraction effect, after the execution of the fabric to a dying process.

As to the use of the threads, any desired types can be used. Furthermore, the thread may be any of the one which is obtained by natural fibers and/or synthetic fibers. Furthermore, as already explained, as for a weft yarn, a textured yarn, such as a wooly nylon may be used, which is, during the picking operation, used for every several warp yarns, for example, for every eight warp yarns. As a result, a construction is obtained, which is less apt to be loosened at the opening of the collar 20, the sleeve 22 and the hemline 24.

In order to separate a garment from the fabric in FIG. 1, a cutting along the lines 18A, 18B and 18C and 20, 22 and 24 is done by using shearing device or scissors which is or are any of a type which is a manually or mechanically operated. The lines 18A, 18B and 18C are the portions where the front and the back bodies are interwoven with each other, whereas the front and back bodies must not be separated after the cutting to the garment. As a result, the cutting along the lines 18A, 18B and 18C is such that the interwoven parts along the lines are at least partially left. In view of this, it may be possible that, at the openings of the collar 20, sleeve 22 and base 24, the threads constructing the warp and weft yarns are loosened. In order to make the loosening to be less likely, stretchable yarns as weft yarns may be used. As an alternative, an arrangement of the repeated pattern 10 is such that the cuttings run in the direction parallel to warp or weft direction as less as possible. As a further alternative, at areas A, L and Q along the openings of the collar 20, the sleeve 22 and the base 24 a particular type of weave such as a plain weave or a twill can be employed which have an increased degree of crossing, which makes the loosening to be less likely.

In FIG. 7, the opening at the sleeve 22 is formed as a saw-tooth shape. In this case, in addition to the cut line 22, additional cut lines 22' and 22' of saw-tooth shape are provided. Namely, according to the present invention, a desired one cut line among the three cut lines 22, 22' and 22" may be selected in accordance with the size of the wearer.

In the similar way, as to the collar 20 and the base 24, the difference cut lines, one of which is suitably selected in accordance with the wearer's size, can also be provided. A wearer can wear the garment cut from the fabric as it is. Otherwise, one can wear the garment by turning it over. In the latter case, the interwoven parts are hidden inside the garment, while recessed portions 26 and 28 on the interweaving lines 18B and 18C, respectively function as sleeve pocket and side pocket, respectively.

Figure 8A:
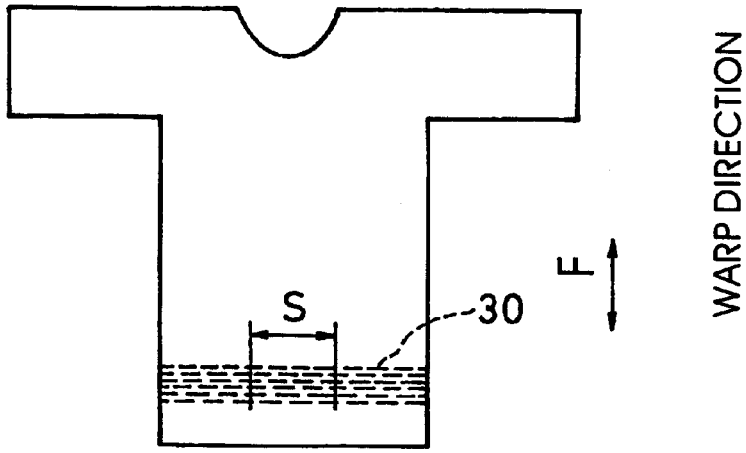
FIGS. 8A and 8B illustrate an embodiment where elastic yarns as weft yarns are partly employed at a base portion of a garment.
Figure 8B:
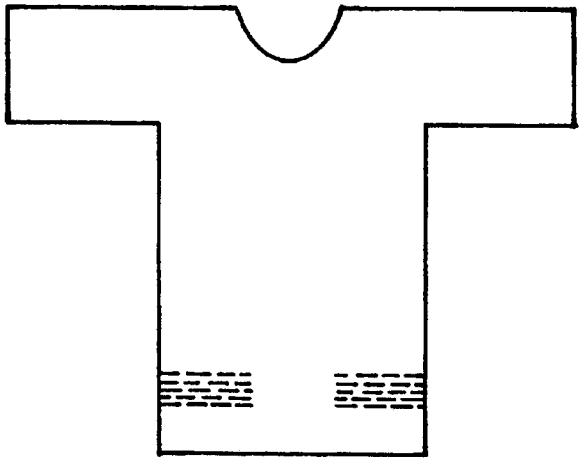

FIGS. 8A and 8B show a modification of the present invention where, in warp direction, elastic yarns such as polyurethane yarns are partially used. In these figures, an arrow F corresponds to the wrap direction. The contour line of a garment (repeated pattern) is shown extremely roughly for the sake of the simplicity of the explanation. However, as similarly shown in FIG. 1, the contour line can extend in the direction other than the warp or weft direction. In FIG. 8A, at the area of the garment adjacent the hemline, elastic yarns 30 are used in the weft direction as shown by dotted lines. When weaving the fabric in FIG. 8A, the weft yarns 30 are, at portions of the weft length S, made to be fully floated, i.e., do not cross any warp yarns at all. After the completion of the weaving of the fabric, the floated portions S of the weft yarns are subjected to a shearing as shown in FIG. 8B. As a result, after cutting to a garment from the fabric, the elastic yarns are subjected to a shrinkage under their elasticity. In other words, a contraction to some extent is obtained at the base portion of the garment.

Figure 9:
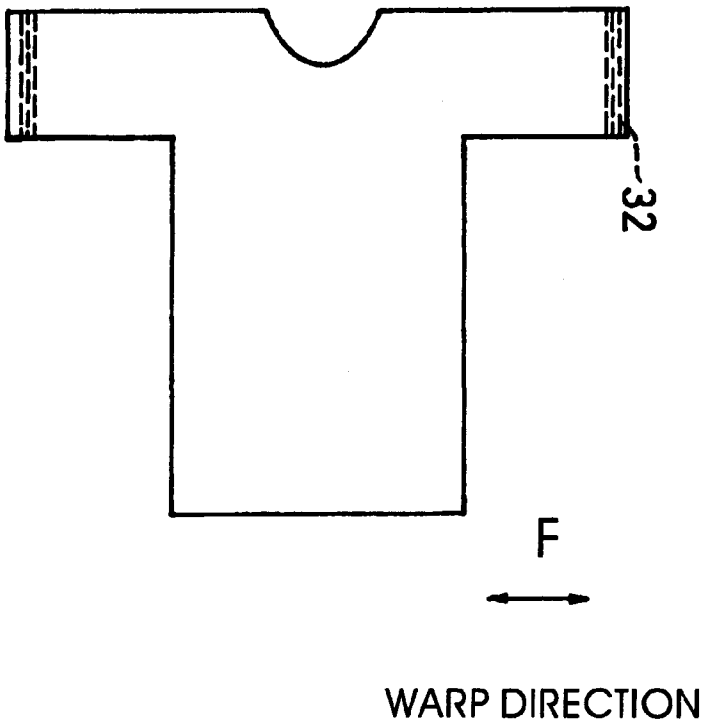
FIG. 9 illustrates a different embodiment where elastic yarns as weft yarns are partly employed at sleeve portions of a garment.

FIG. 9 shows a modification, wherein elastic yarns 30 in a weft direction are used at a portion of the sleeve of a garment. In this figure, an arrow F corresponds, therefore, to the warp direction. When garment is cut from the fabric, the elastic yarns 32 at the sleeve are subjected to an elastic shrinkage. Thus, some degree of contraction is obtained at the sleeve of the garment.

Figure 10:
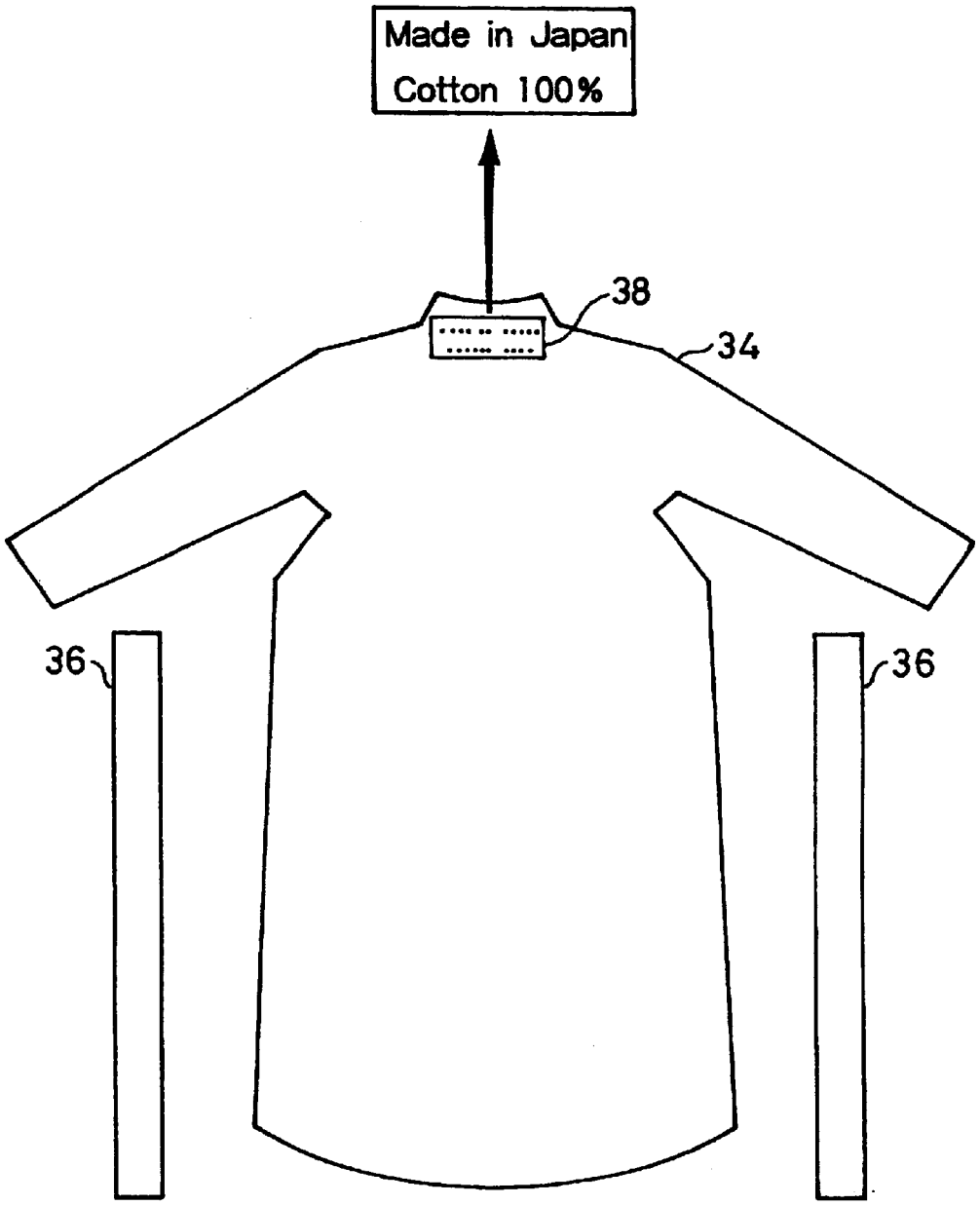
FIG. 10 illustrates an embodiment of the present invention in which, at marginal areas, other parts of the garment, such as straps or bands, are formed and a tug as a woven structure is integrally formed in the garment.

FIG. 10 illustrates another modification of the present invention, which illustrates the effective use of a marginal area of the fabric after the cutting along the contour line 34 of the garments. Namely, in this embodiment, at the area outside the contour lines of the garments, parts 36 such as a belt or string are formed. These parts 36 may be constructed by any of desired weave structure including a hose weave or, even, a mere single weave. When a hose weave is employed, a interweaving between the layers is done along a contour of a article such as gloves and socks, which may be separated by cutting the fabric along the contour line.

In FIG. 10, the garment has a tag 38 located at a portion adjacent the collar in the back body of the garment. In a conventional construction of a garment, such a tag is formed by a separate woven sheet and is sewn to the fabric. According to the present invention, the use of the jacquard allows each of the warp yarns to be moved for an independent shedding operation. In other words, a very fine pattern such as letters or characters can be integrally woven in the fabric. Thus, according to the present invention, an expression by the letters in the tag 38, such as "Made in Japan" and "Cotton 100%" is woven in the fabric. In the similar way, a trade mark and/or a trade name can also be woven in the tag 38 according to the present invention.

Figure 11:
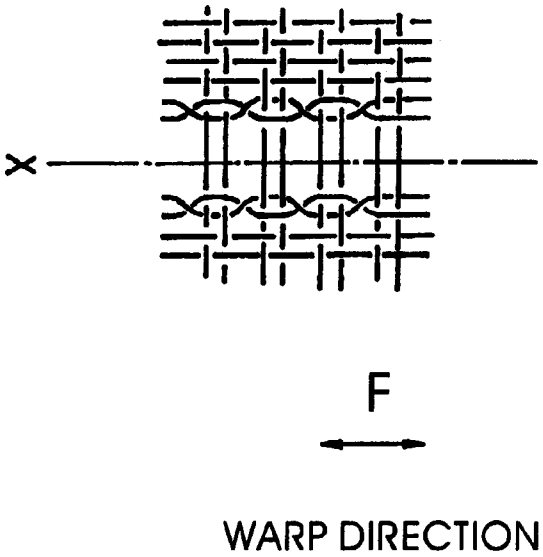
FIG. 11 illustrates very schematically a formation of a button hole by using a gauze weave.

As a preferable modification, it is possible that a buttonhole is integrally formed in the fabric. It is possible to construct a buttonhole in the fabric by a leno or gauze fabric. Namely, in FIG. 11, the fabric is basically formed as a plain weave having warp yarns and weft yarns which are crossed with each other under a usual manner. The shown direction F corresponds to the direction of the warp yarn. At a region of the fabric where a buttonhole is to be created, warp yarns are crossed with each other while crossed with weft yarns by using a Doup heald which is well known to those skilled in the art. As a result, as shown in the drawing, an opened area is created between the crossed warp yarns. At the opened area, the weft yarns are cut along the line as shown by X, thereby creating, at the local area, a buttonhole.

In the embodiment of the fabric according to the present invention shown in FIG. 7, the areas corresponding to the front and back bodies of the garment may have a pattern of desired colors. However, it is also possible that the fabric can be purely a plain one even at the location corresponding to the front and back bodies of a garment. In this case, a dying such as by a printing is suitably done. Namely, according to the present invention, the same type of the garments of wide varieties including, for example, the one with woven pattern, the plain one and the one with a printing are obtained.

Furthermore, in the above embodiment of the present invention, the outer contour of the garment has a completely interwoven structure except at location of the openings for the passage of a human body, such as a collar, sleeve and hemline. However, the present invention includes such a construction where the interweaving is partly done along the outline of the garment.

Figure 12:
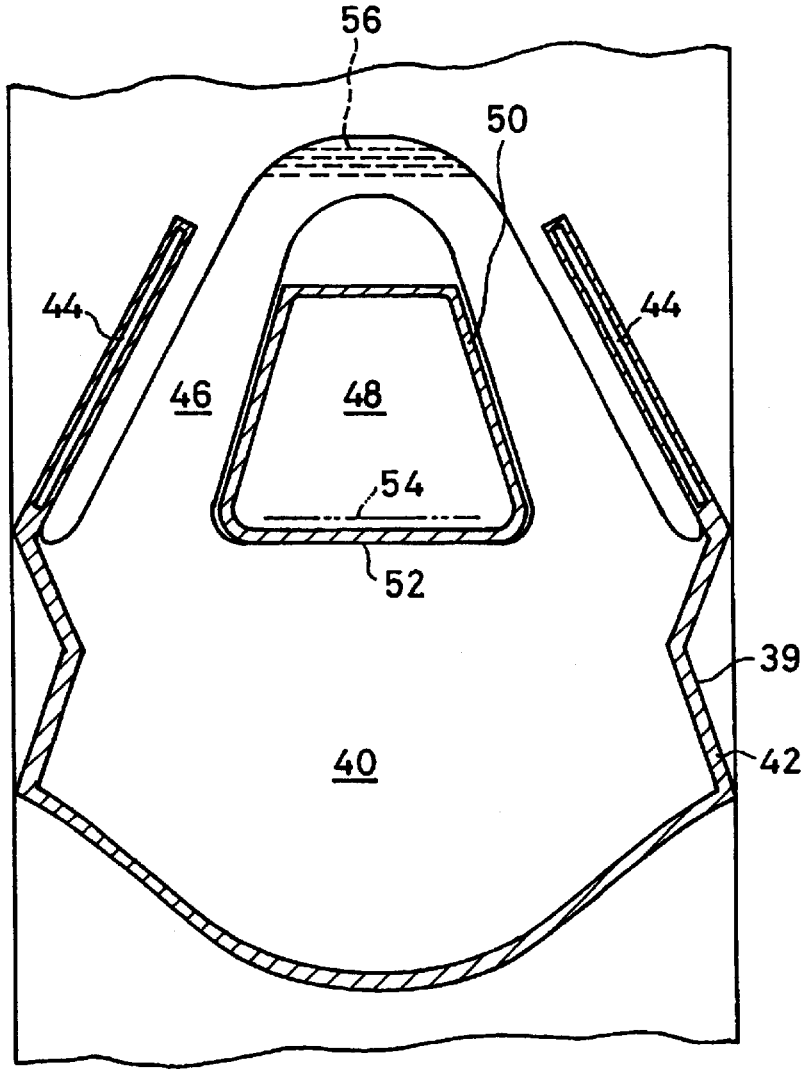
FIG. 12 is a further embodiment of a fabric according to the present invention where shoulder bags can be cut from the fabric.

The idea of the present invention can be applied to an article other than the garment. FIG. 12 shows an application of the idea of the present invention to a shoulder bag. Namely, in FIG. 12, a hose fabric is shown, which has an upper layer in the plane of the paper and a lower layer located below the upper layer. In FIG. 12, the reference numeral 39 denotes an outline of a shoulder bag. Namely, inside the contour line 39, a main portion 40 in one side of the fabric becomes one side of the shoulder bag, while another main portion in the other side of the fabric, which is not shown but is located below the portion 40, becomes the other side of the shoulder bag. A cutting by a scissors is done along the contour line 39, which allows a shoulder bag to be separated from the fabric.

Shaded portions 42 inside and along almost the half of the contour line 39 represents interwoven portions, which are as similar to the portions 18A, 18B and 18C in the first embodiment constructed as a Bedford weave by which the upper and the lower layers are interwoven with each other, thereby forming a storing space of the shoulder bag.

The fabric in FIG. 12 includes portions 44 elongated from the both of the upper ends of the contour line 39. At each of the elongated portions 44, the upper and the lower surfaces are interwoven with each other along the closed contour as shown by shaded lines. These elongated portions 44 function as tie strings when the fabric is cut to the bag.

The fabric in FIG. 12 is also provided with loop shaded portions 46 integrally extending from the main portions 40, respectively, which are not interwoven, so that, after the cutting of the fabric along the contour line, these portions 46 are separated with each other and function as shoulder straps of the shoulder bag.

On one of the main portions, i.e., the portion 40 has an integrated portion 48 which is located inwardly from the loop shaped portion 46 and which functions as an inner sack of the shoulder bag. Namely, the portion 48 is, itself, formed as double fabric having upper and lower layers, which are interwoven along the contour line 50 as shown by shaded lines. This portion 48 is, in this embodiment, made integral with respect to the upper main part 40 by way of a connecting line 52. Thus, even when a cutting of the fabric along the contour lines 39 and 50 is done, the inner bag can maintain its integrated state with respect to the upper main layer 40 of the bag. In the inner bag 48 as a double fabric, in the upper fabric layer, a cutting along a lower line 54 located adjacent the connecting line 52 is done. Then, after the execution of the cutting to the shoulder bag, the portion 48 is folded inwardly as shown in FIG. 13, so that the portion 48 can function as an inner bag, which has a top opening 54' at its upper end.

Figure 13:
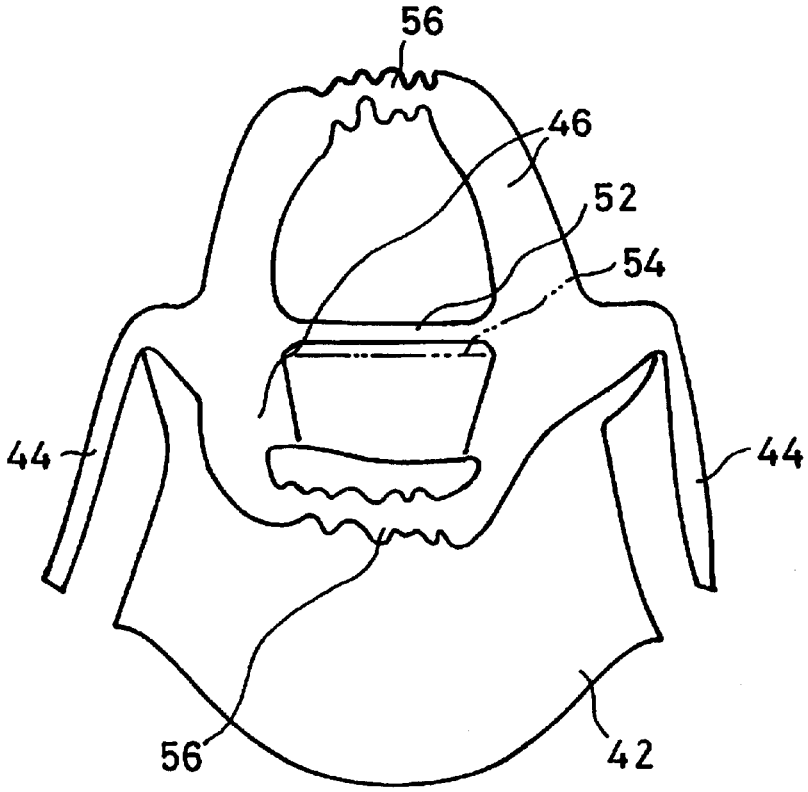
FIG. 13 is a schematic perspective view of a shoulder back separated from the fabric shown in FIG. 12.

In FIG. 12, in the upper portion of the part 46 functioning as a shoulder strap, elastic yarns are inserted and woven as shown by dotted lines 56, which allows the portion to be shrunken under the elasticity of the yarn, thereby forming a gathered portion as clearly shown in FIG. 13. Furthermore, at the upper ends of the both of the main parts 40 constructing a bag space, elastic yarns are woven as shown by the dotted lines 58, thereby causing the bag to be, at its top or inlet portion, gathered or narrowed. Furthermore, in the inner bag, at the upper and lower layers, elastic yarns are also woven as shown by dotted lines 60, thereby causing the bag to be, at its inlet end, gathered or narrowed.

What is claimed is:

1. A woven fabric having repeated patterns to be cut to articles, said fabric comprising a plurality of layers woven by jacquard, among which layers at least one first layer becomes one side of the article while at least one remaining second layer becomes the other side of the article, said fabric further comprising interwoven portions for interweaving said first and second layers each other along a contour line of said article except at locations adapted to become openings of the article as produced, said repeated pattern constructed by said interwoven portions being distributed along substantially entire length and width of the fabric.

2. A fabric according to claim 1, wherein said article is a garment.

3. A fabric according to claim 2, wherein said first layer is a front body of the garment and said second layer is a back body of the garment.

4. A fabric according to claim 1, wherein said article is a bag.

5. A fabric according to claim 4, wherein said fabric includes elongated portions integrated to said layers of the fabric, said elongated portions functioning as a strap or string of the bag when the latter is cut from the fabric.

6. A fabric according to claim 4, wherein said fabric includes a portion integrated to said one of the first and second layers of the fabric, which portion functions as an inner pocket of the bag.

7. A woven fabric having repeated patterns to be cut to garments, said fabric comprising a plurality of layers woven by a jacquard, among which layers at least one first layer becomes a front body of a garment while at least one remaining second layer becomes back body of a garment, said fabric further comprising interwoven portions for interweaving said first and second layers each other along a contour line of the garment, said repeated pattern constructed by said interwoven portions being distributed along substantially entire length and width of the fabric.

8. A method for forming articles from a fabric comprising the steps of:

weaving, by using a jacquard, a fabric having a plurality of layers, among which layers, at least one first layer becomes one side of the article while the remaining at least one second layer becomes the other side of the article, while interweaving said first and second layers with each other along a contour line of the article, and;

cutting the fabric along said contour line, thereby separating, from the fabric, an article in which the first and second layers are connected with each other by means of the interweaving except at a location which becomes an opening of the article.

9. A method according to claim 8, wherein said article is a garment et al.

10. A method according to claim 8, wherein said article is a bag et al.

11. A method for forming garments from a fabric comprising the steps of:

weaving, by using a jacquard, a fabric having a plurality of layers, among which layers, at least one first layer becomes one side of the garment while the remaining at least one second layer becomes the other side of the garment, while interweaving said first and second layers with each other along a contour line of the article, and;

cutting the fabric along said contour line, thereby separating, from the fabric, a garment in which the first and second layers are connected with each other by means of the interwoven parts except at a location which becomes an opening of the garment, such as a collar or neck, a sleeve or a base or a hemline et al.

* * * * *